US008038543B2

(12) United States Patent
Capesius

(10) Patent No.: US 8,038,543 B2
(45) Date of Patent: Oct. 18, 2011

(54) GOLF SWING TRAINING DEVICE

(76) Inventor: Dean C. Capesius, Livermore, IA (US)

( * ) Notice: Subject to any disclaimer, the term of this patent is extended or adjusted under 35 U.S.C. 154(b) by 0 days.

(21) Appl. No.: 12/615,550

(22) Filed: Nov. 10, 2009

(65) Prior Publication Data

US 2010/0120549 A1 May 13, 2010

Related U.S. Application Data

(60) Provisional application No. 61/198,877, filed on Nov. 10, 2008.

(51) Int. Cl.
*A63B 69/36* (2006.01)

(52) U.S. Cl. ..... 473/257; 473/268

(58) Field of Classification Search ..... 473/219, 473/257, 261, 264, 265, 266, 268, 270, 272, 473/273, 409; D21/791
See application file for complete search history.

(56) References Cited

U.S. PATENT DOCUMENTS

| | | | | |
|---|---|---|---|---|
| 2,669,782 | A * | 2/1954 | Turner | 473/268 |
| 3,375,010 | A * | 3/1968 | Panza | 473/264 |
| 4,796,892 | A * | 1/1989 | Doerrfeld | 473/268 |
| 5,338,037 | A * | 8/1994 | Toyohara | 473/268 |
| 5,375,833 | A * | 12/1994 | Marier, Jr. | 473/261 |
| 6,780,122 | B2 * | 8/2004 | Belanger | 473/257 |
| 6,949,030 | B1 * | 9/2005 | Gauer | 473/257 |
| 2007/0087856 | A1 * | 4/2007 | Rodriguez et al. | 473/257 |

* cited by examiner

*Primary Examiner* — Nini Legesse
(74) *Attorney, Agent, or Firm* — McKee, Voorhees & Sease, P.L.C.

(57) ABSTRACT

The golf swing training device of the present invention includes a base positioned on the floor or ground in front of a golfer. A leg extends pivotably upward from the base. An arm is pivotally attached to the leg and extends forwardly toward the golfer. A frame is provided on the arm, with an extension member extending pivotally forwardly from the frame. The leg, frame, and extension member are each adjustable to accommodate various heights and postures of different golfers. The device can also be used with both right-handed and left-handed golfers. In use, the golfer views the golf ball through the frame and swings the golf club through a proper swing plane with hands passing beneath the extension member without contact.

20 Claims, 8 Drawing Sheets

GOLF SWING TRAINING DEVICE

CROSS-REFERENCE TO RELATED APPLICATIONS

This application claims priority under 35 U.S.C. §119(e) to provisional application Ser. No. 61/198,877 filed Nov. 10, 2008, herein incorporated by reference in its entirety.

BACKGROUND OF THE INVENTION

The present invention relates to golf swing training aids and golf swing training methods.

Important to a fundamentally sound and repeating golf swing is the ability to consistently deliver the clubhead at impact on the proper path and with the club face square to the target line. Golf instructors often refer to delivering the clubhead to the ball "on plane". The plane is defined by two lines—one drawn through the club shaft at address and the other along the target line. At address, the club shaft will lie on the plane, and ideally the golfer will want to return the club shaft on the same plane at impact.

Golfers who slice the golf ball tend to cut across the ball on a swing path in which the club travels from outside the target line to inside the target line on the downswing. This is often referred to as "coming over the top" on the downswing and is the cause of much inconsistency and poor ball striking. An "over the top" swing will usually result in the shaft of the club extending from the ball at impact at a more upright angle than at address. That is, the golfer's hands will be in a higher position at impact with the club shaft lying in a more upright plane as compared with the plane established by the club shaft at address.

Delivering the clubhead to the ball from too far inside the target lines is also problematic, often resulting in poor ball contact with the golfer pushing and hooking shots. Again, the golfer is unable to return the clubhead to the ball on plane.

A need therefore exists in the art to help golfers minimize the difference between the shaft angle or swing plane at address and the shaft angle or swing plane at impact.

There is also a need in the art for a golf training aid or device that will give the user feedback as to whether the user's club is in the proper position at impact.

There is also a need in the art for a golf training aid or device that can be easily adjusted to account for differences in size and posture from one golfer to another.

Therefore, a primary objective of the present invention is the provision of an improved golf swing training device.

Another objective of the present invention is the provision of a golf swing training device which quickly and easily teaches a golfer the proper swing plane.

A further objective of the present invention is the provision of a golf swing training device which teaches a golfer to duplicate the swing plane at address and at impact.

Yet another objective of the present invention is the provision of a golf swing training device which generates muscle memory for a golfer using the device.

Still another objective of the present invention is the provision of a golf swing training device which is adjustable to accommodate all golfers, regardless of size and swing posture.

Another objective of the present invention is the provision of a golf swing training device which can be used by both right-handed and left-handed golfers.

A further objective of the present invention is the provision of a golf swing training method which accurately positions the golfer's hands for a proper swing.

Another objective of the present invention is the provision of a golf swing training method which provides instant feedback to the golfer.

A further objective of the present invention is the provision of a golf swing training method which teaches the golfer the proper swing plane.

These and other objectives will become apparent from the following description of the invention.

SUMMARY OF THE INVENTION

The golf swing training device of the present invention is intended to improve a golfer's swing by encouraging the angle of the club shaft at ball impact, viewed from down the target line, to mirror the angle of the club shaft at address. Ideally, the club shaft should return to the same plane during impact as at address so as to maximize distance and accuracy for a ball struck with a wood or iron.

The golf swing training device of the present invention includes a base set on the ground or floor in front of a golfer with an upwardly extending leg pivotally attached to the base. An arm is pivotally connected to the leg so as to extend toward the golfer and be rotatable about the axis of the leg. A frame on the arm defines a window through which the golf ball is viewed by the golfer during use of the training device. The arm terminates in an extension pivotally mounted to the frame. A foam sleeve is slidingly received on the extension and has an outer end which is adjusted to a position between the golfer's wrist and thumb knuckle on the lower hand on the club. The sleeve is selected from a set of different length sleeves, depending upon the length of the club being used by the golfer.

The golfer positions a ball on the ground or mat so as to be viewed through the frame or window. The golfer address the ball, with the arm extension in foam sleeve being substantially parallel to the angle of the club shaft. The golfer then takes a back swing and front swing so as to hit the ball while looking through the frame, with the hands passing beneath the foam sleeve on the arm extension, thus duplicating the swing plane from the ball address during ball impact.

DETAILED DESCRIPTION OF THE PREFERRED EMBODIMENT

Figure 1:
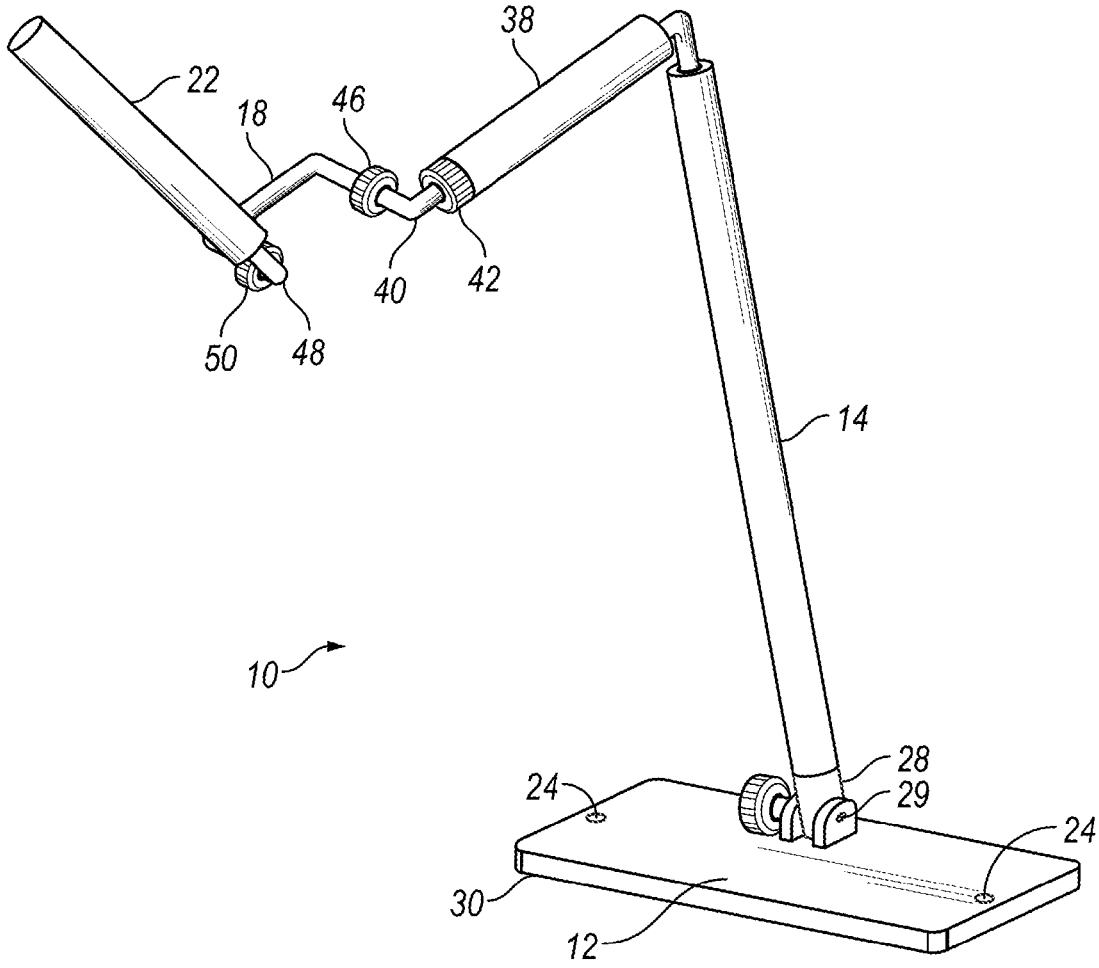
FIG. 1 is a perspective view of the golf swing training device of the present invention as set up for a right-handed golfer.
Figure 2:
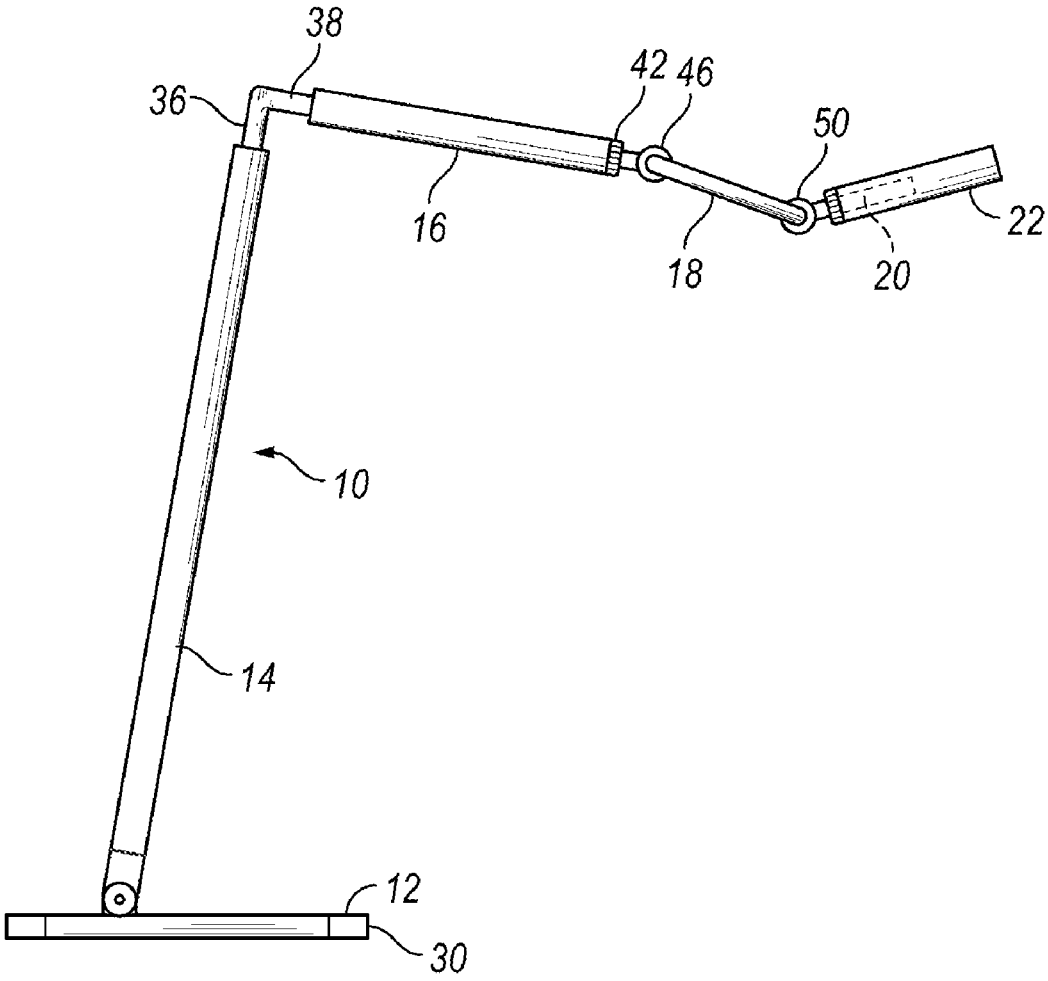
FIG. 2 is a side elevation view of the device shown in FIG. 1.

The device of the present invention is generally designated in the drawings by the reference numeral 10. The basic components of the device 10 are a base 12 which sits upon the floor or ground, a leg 14 pivotally connected to the base 12 and extending upwardly therefrom, an arm 16 pivotally or rotatably mounted to the leg 14, a frame 18 pivotally connected to the arm 16, an extension 20 pivotally connected to the frame 18, and a foam sleeve 22 removably mounted on the extension 20. The device 10 may be used either indoors or outdoors. The base 12 includes holes 24 to receive stakes 26 to secure the device 10 to the ground when used outdoors, if necessary.

The components of the device 10 are interconnected with adjustable couplings so that the device 10 can be used with any golfer, regardless of height or posture. More particularly, the base 12 includes a socket 28 mounted on the base for pivotal movement about a horizontal axis 29. Thus, the socket 28 can move in a vertical plane toward and away from the front edge 30 of the base. The socket is locked in the desired position in any convenient manner. For example, a thumb screw or set screw can be used to set the socket at the desired angle relative to the base 12. Alternatively, the socket 28 may have a universal joint so as to be positionable in various planes.

The lower end of the leg 14 is received in the hollow upper end of the socket 28 and is fixed in the socket 28 by tightening a wing nut 34, thumb screw, or other fastener or clamp. Alternatively, the lower end of the leg 14 may be placed over the upper end of a shaft extending upwardly from the base 12.

The arm 16 is L-shaped. The lower or inner segment 36 of the arm 16 is adapted to be slidably received in or over the upper end of the leg 14 so as to be pivotable or rotatable about the longitudinal axis of the leg 14. The upper or outer segment 38 of the arm 16 extends forwardly. An elbow 40 is mounted on the upper segment 38 via a threaded coupler 42 so as to be rotatable about the longitudinal axis of the upper end 38 of the arm 16. The frame 18 is pivotally attached to the elbow 40 with a second threaded coupler 46. A second elbow 48 is attached to the frame 18 with a third threaded coupler 50. Then extension member 20 is fixed to the second elbow 48 so as to extend forwardly from the frame 18. In the preferred embodiment, the frame 18 is C-shaped, as shown in the drawings. In an alternative embodiment, the frame 18 may be a full rectangle or other geometric shape, as shown in the figures of the parent provisional application, U.S. Ser. No. 61/198,877 filed on Nov. 10, 2008.

The foam sleeve 22 is removably slid over the extension member 20. Similarly, foam sleeves may also be provided on the upper segment 38 of the arm 16 and on the leg 14. The foam sleeve 22 may be selected from a set of sleeves each having different lengths, with the length of the selected sleeve 22 corresponding to the length of the golf club being used by a golfer. For a driver, the golfer selects the longest foam sleeve; for short irons, the golfer selects the shortest sleeve; and for long irons and fairway woods, the golfer selects the intermediate sleeve.

The leg 14, the arm 16, the frame 18, the extension member 20, and the elbows 40 and 48 are preferably made of PVC pipe or other lightweight, rigid material. The base 12 has a weight sufficient to support the leg 14, the arm 16, the frame 18, and the extension member 20 when oriented in the use position. Foam sleeves may also be used on the leg 14 and the outer segment 38 of the arm 16.

Figure 3:
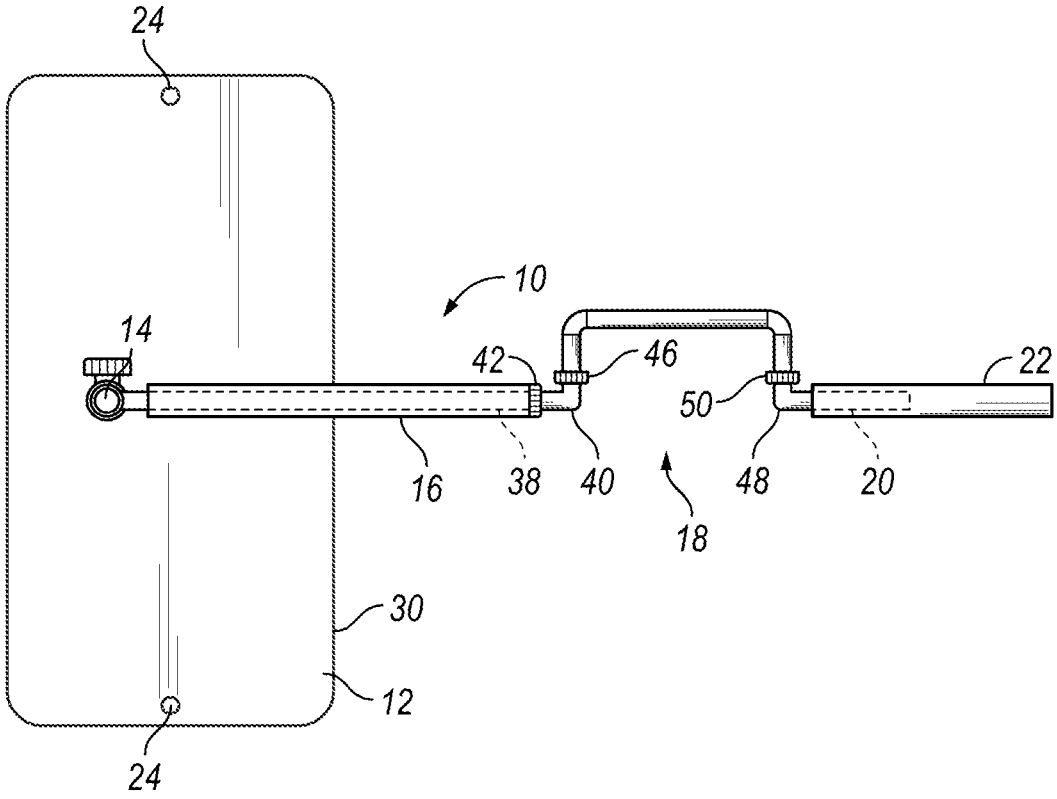
FIG. 3 is top plan view of the device shown in FIG. 1.
Figure 4:
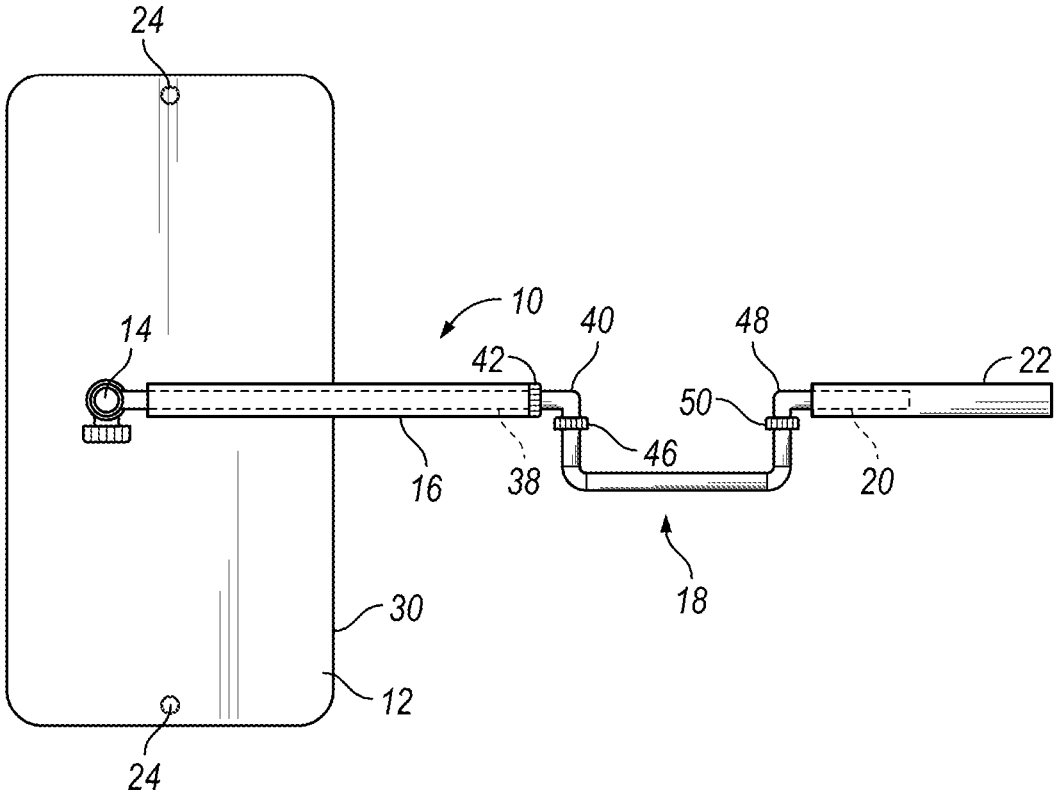
FIG. 4 is a top plan view of the device set up for a left-handed golfer.
Figure 5:
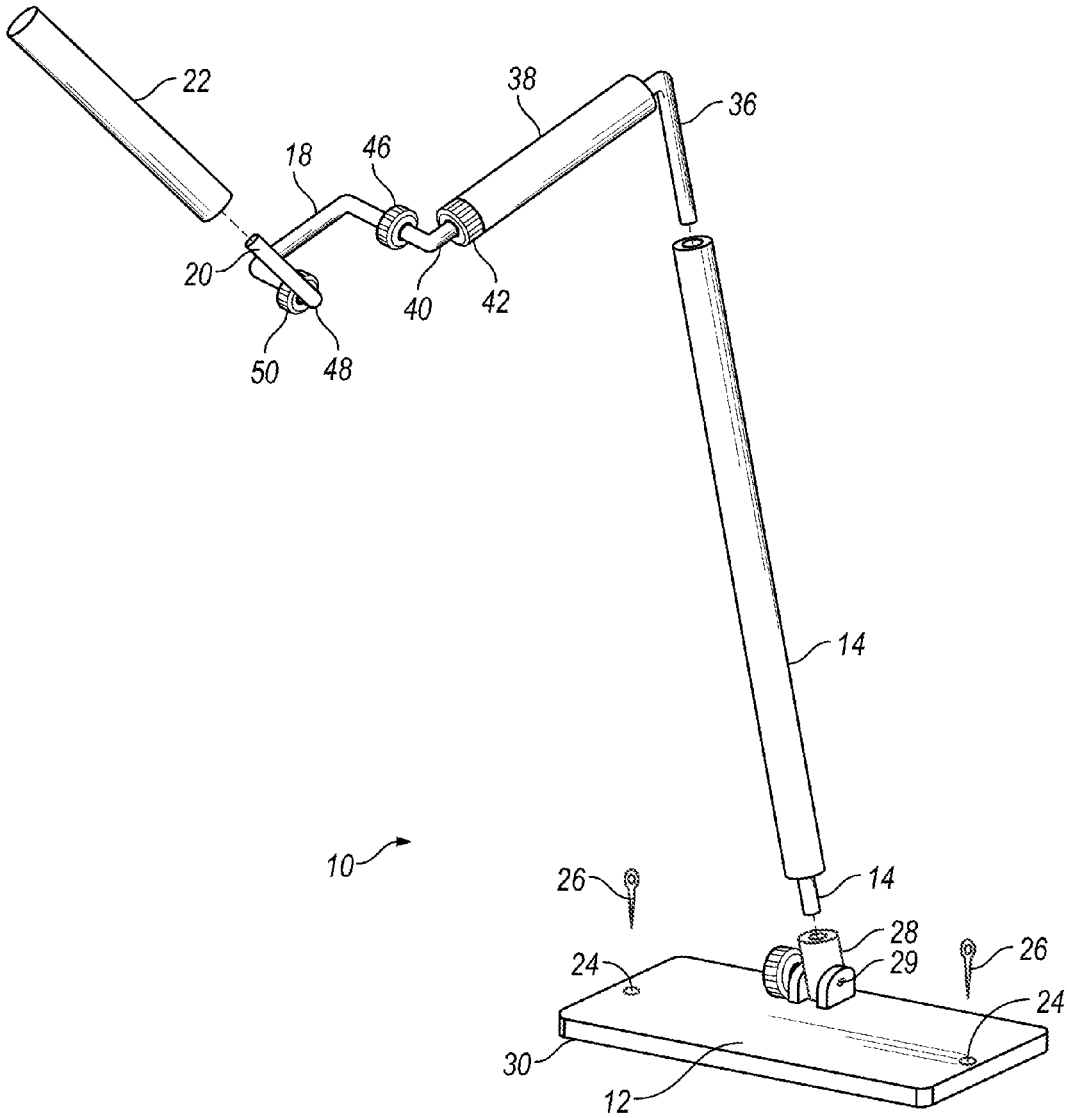
FIG. 5 is an exploded view of the components of the device.

The first coupler 42 allows the frame 18 to be rotated 180° between left and right positions for right-handed and left-handed golfers, respectively, as seen in FIGS. 3 and 4. If a rectangular frame is utilized, rotation for right-handed and left-handed golfers is not needed.

The second coupler 46 allows the angle of the frame 18 to be adjusted about a horizontal axis. Similarly, the third coupler 50 allows the angle of the extension member 20 to be adjusted about a horizontal axis. Preferably, the angle of the extension member 20 will be substantially parallel to the axis of the golf club shaft when a golfer addresses a golf ball viewed through the frame 18.

In use, a golfer sets a golf ball 52 on a tee or on the mat or ground beneath the upper segment 38 of the arm 16 so that the ball can be seen through the frame 18. Preferably, the golf ball should appear at approximately the center of the frame 18. If the golfer and ball are too close together, the ball will be near or outside the rearward end of the frame 18. If the golfer and ball are too far apart, the ball will appear near or outside the forward end of the frame 18. The golfer should adjust the angular orientation of the extension member 20 so as to be substantially parallel to the club shaft position when the golfer addresses the ball. The club shaft angle at address is the preferred swing plane which the golfer seeks to duplicate or mirror when swinging the club through impact. If the golfer varies the swing plane during his or her swing, the golfer's hands will hit the foam sleeve 22. Such contact with the sleeve 22 will cause the arm 16 to pivot about the leg 14, and thereby prevent injury to the golfer. Through practice with the device 10, the golfer receives immediate feedback and will develop muscle memory for the proper swing plane, with the hands coming beneath the extension member 20 during impact with the ball. It is understood that such practice can also be done using the device 10, but without a ball.

Figure 6:
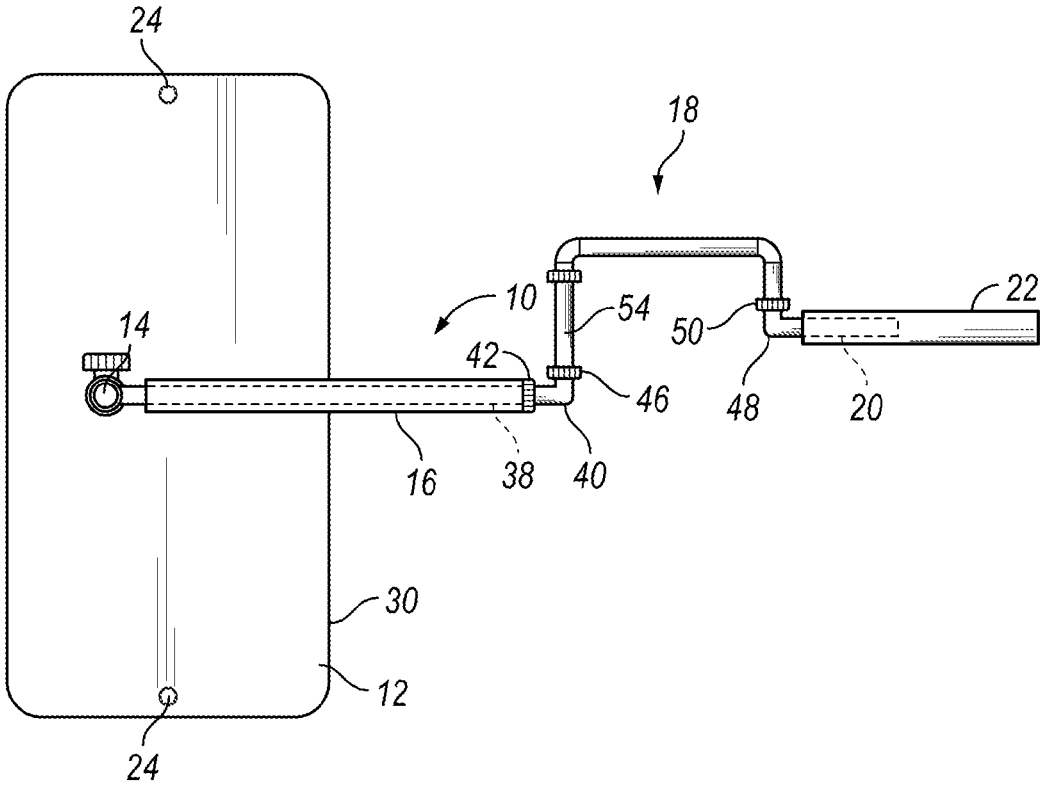
FIG. 6 is a view of an alternative embodiment of the device with a frame extender for use by a golfer having an excessive over the top swing.

FIG. 6 shows an alternative embodiment of the device 10, wherein a frame extender 54 is coupled between the frame 18 and the extension member 20. The frame extender 54 is intended for use with a golfer having a severe or excessive over the top or inside the outside swing pass, and helps such a golfer from swinging severely from the outside.

Figure 7:
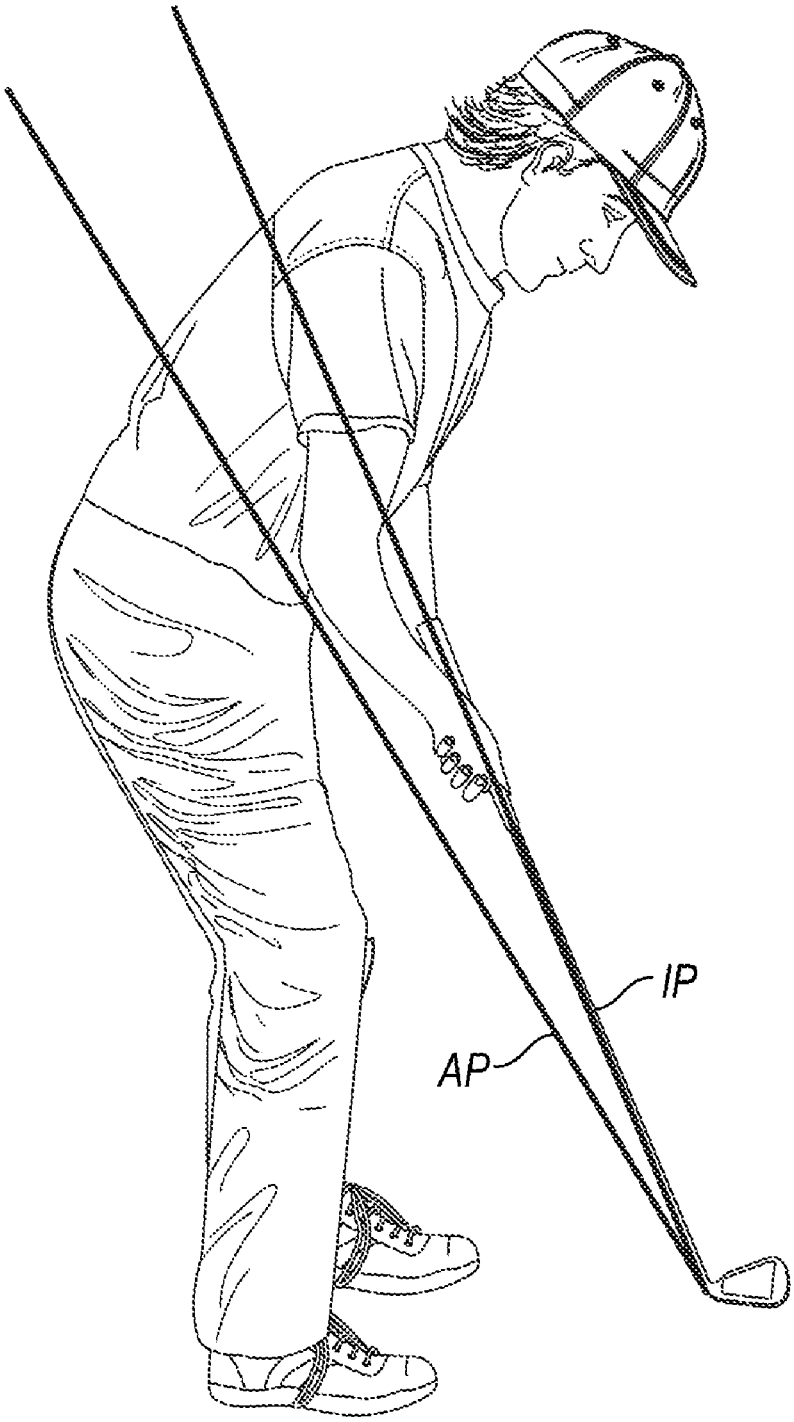
FIG. 7 is a sketch showing a golfer having a substantial difference in the swing plane from address to impact.
Figure 8:
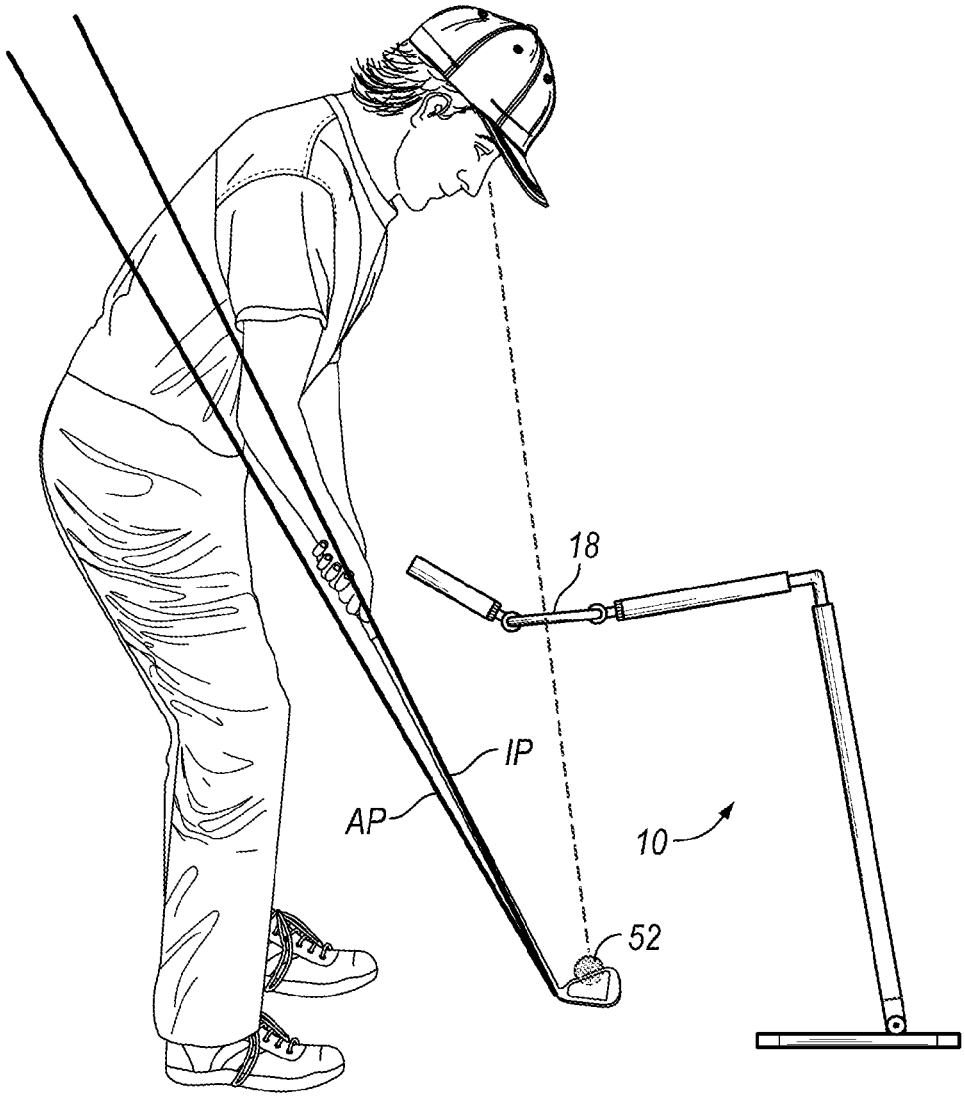
FIG. 8 is a sketch showing a golfer having substantially similar swing planes at ball address and impact, as taught by use of the invention.

FIG. 7 shows the difference between the proper swing plane at address, designated by the line AP (address plane) and an improper swing plane at impact, designated by the line IP (impact plane). The angle between the lines AP and IP is undesirably wide. In comparison, FIG. 8 shows a much narrower and more preferred angle between the lines AP and IP. Ideally, there will be no angular difference between the AP and IP, which means that the golfer is duplicating the proper swing plane at both the ball address and the ball impact. Use of the device 10 helps a golfer achieve this proper and desired, repeatable swing plane.

The invention has been shown and described above with the preferred embodiments, and it is understood that many modifications, substitutions, and additions may be made which are within the intended spirit and scope of the invention. For example, the male and female connections between the components can be reversed, such as between the socket 28 and the leg 14, or between the leg 14 and the arm 16. From the foregoing, it can be seen that the present invention accomplishes at least all of its stated objectives.

What is claimed is:

1. A golf swing training device, comprising:

a base adapted to be positioned in front of a golfer;

a leg pivotally attached to the base and having an upwardly extending longitudinal axis;

an arm pivotally attached to the leg for rotation about the longitudinal axis of the leg and extending toward the golfer;

a window on the arm through which a golfer's line of sight passes in viewing a golf ball; an extension member pivotally mounted to the window and extending from the window toward the golfer; and the window residing between the arm and the extension member.

2. The golf swing training device of claim 1 wherein the leg, arm and window are adjustable so as to fit different golfers' statures.

3. The golf swing training device of claim 1 wherein the window is rotatable 180° about a longitudinal axis of the arm between right and left positions for right-handed or left-handed golfers, respectively.

4. The golf swing training device of claim 1 further comprising a foam sleeve removably mounted on the extension member.

5. The golf swing training device of claim 4 wherein the foam sleeve is selected from a set of different length sleeves.

6. The golf swing training device of claim 1 further comprising a window extender removably coupled to the window for use by golfers having an excessive over-the-top swing.

7. The golf swing training device of claim 1 wherein the window includes threaded couplers for connection to the arm and to the extension member so as to allow angular adjustability of the window relative to the arm and to the extension member.

8. The golf swing training device of claim 1 wherein the base and leg are slip fit together, and the leg and arm are slip fit together for assembly and disassembly.

9. The golf swing training device of claim 1 wherein the extension member is pivotally attached to the window for rotational adjustment about a horizontal axis.

10. A device for teaching a proper golf swing plane, comprising:

a window supported above a golf ball;

an extension member having a first end pivotally connected to the window for rotation about a substantially horizontal axis and having a second end extending toward a golfer addressing the ball whereby the golfer views the ball through the window and swings a golf club so to hit the ball while avoiding contact with the extension member; and the extension member residing between the golfer's hands and the window.

11. The device of claim 10 wherein the window and extension member are adjustable to accommodate different height golfers.

12. The device of claim 10 further comprising a base, a leg extending upwardly from the base, and an arm extending forwardly from the leg, and the frame being mounted on the arm.

13. The device of claim 12 wherein the arm is pivotal relative to a longitudinal axis of the leg.

14. The device of claim 10 further comprising a foam sleeve removably fit onto the extension member.

15. The golf swing training device of claim 14 wherein the foam sleeve is selected from a set of different length sleeves.

16. A golf swing training method, comprising:

positioning a golf swing training device in front of the golfer, the device having a base, an upstanding leg connected to the base, an arm extending from the leg toward the golfer, a window on the end of the arm, and an extension member extending from the window towards the golfer and terminating adjacent the golfer's grip on a club;

setting a golf ball in a position to be hit beneath the arm;

the golfer looking beyond the extension member to view the ball through the window with the extension member residing between the golfer and the window;

swinging a golf club beneath the arm to strike the ball while looking through the window; and pivoting the arm, window and extension member about a longitudinal axis of the leg when the golfer hits the extension, while the base and leg remain substantially stationary.

17. The golf swing training method of claim 16 further comprising adjusting the position of the extension member and window so as to fit a particular golfer.

18. The golf swing training method of claim 16 further comprising rotating the window 180° about a longitudinal axis of the arm between right and left positions for right-handed and left-handed golfers, respectively.

19. The golf swing training method of claim 16 further comprising selecting a foam sleeve from a set of different length foam sleeves, and then slipping the selected foam sleeve over an end of the extension member, the selection corresponding to the length of the club being used by the golfer.

20. The golf swing training method of claim 16 further comprising avoiding contact with the extension member during the swing for a proper swing plane.

* * * * *